US011181248B1

(12) United States Patent
Kothari

(10) Patent No.: US 11,181,248 B1
(45) Date of Patent: Nov. 23, 2021

(54) TEMPORARY AND/OR EMERGENCY LIGHTING SYSTEM WITH INFLATABLE STRUCTURE USING AN LED ARRAY

(71) Applicant: Manish Kothari, Jacksonville, FL (US)

(72) Inventor: Manish Kothari, Jacksonville, FL (US)

( * ) Notice: Subject to any disclaimer, the term of this patent is extended or adjusted under 35 U.S.C. 154(b) by 0 days.

(21) Appl. No.: 17/206,952

(22) Filed: Mar. 19, 2021

(51) Int. Cl.

| | |
|---|---|
| ***F21V 3/02*** | (2006.01) |
| ***F21V 29/74*** | (2015.01) |
| ***F21V 23/00*** | (2015.01) |
| ***F21V 23/04*** | (2006.01) |
| ***F21V 29/60*** | (2015.01) |
| ***F21V 15/02*** | (2006.01) |
| ***F21V 29/83*** | (2015.01) |
| ***F21Y 107/40*** | (2016.01) |
| ***F21Y 115/10*** | (2016.01) |

(52) U.S. Cl.
CPC ..... *F21V 3/023* (2013.01); *F21V 3/026* (2013.01); *F21V 15/02* (2013.01); *F21V 23/007* (2013.01); *F21V 23/04* (2013.01); *F21V 29/60* (2015.01); *F21V 29/74* (2015.01); *F21V 29/83* (2015.01); *F21Y 2107/40* (2016.08); *F21Y 2115/10* (2016.08)

(58) Field of Classification Search
CPC ..... F21V 3/023; F21V 3/026; F21V 29/60; F21V 29/74; F21V 29/83; F21V 15/02; F21V 23/007; F21V 23/04; F21Y 2107/40
See application file for complete search history.

(56) References Cited

U.S. PATENT DOCUMENTS

| | | | | |
|---|---|---|---|---|
| 6,322,230 | B1 * | 11/2001 | Medici | F21S 9/022 340/321 |
| 7,246,913 | B2 * | 7/2007 | Ossolinski | B60P 3/18 362/96 |
| 7,264,382 | B2 * | 9/2007 | Yoshimori | F21V 11/04 362/431 |
| 8,931,916 | B2 * | 1/2015 | Nalitchaev | F21V 3/023 362/192 |
| 8,939,593 | B2 * | 1/2015 | Kothari | F21V 3/026 362/96 |
| 11,105,485 | B2 * | 8/2021 | Kothari | F21V 33/0088 |
| 2014/0293603 | A1 * | 10/2014 | Barnard | F21V 29/75 362/241 |
| 2016/0003463 | A1 * | 1/2016 | Rodinger | F21K 9/23 362/249.02 |

* cited by examiner

*Primary Examiner* — Alan B Cariaso
(74) *Attorney, Agent, or Firm* — Lawrence J. Gibney, Jr.

(57) ABSTRACT

In order to provide a temporary lighting solution in extreme weather or lighting conditions, this application has been conceived. A set of blowers will continuously operate to inflate a long cylindrical tube in which a light has been placed to illuminate a designated area. The means of illumination for the device will be an LED light that is mounted to a plate on the top of an inflatable tube. Ventilation holes on the plate to mount the LED light and heat sinks are incorporated to dissipate the heat that is generated by this light.

4 Claims, 6 Drawing Sheets

TEMPORARY AND/OR EMERGENCY LIGHTING SYSTEM WITH INFLATABLE STRUCTURE USING AN LED ARRAY

RELATED TO OTHER APPLICATIONS

This is an improvement of a portable lighting system that was previously patented by the inventor with patent numbers, U.S. Pat. No. 8,939,593 (Issue Date Jan. 27, 2015) and U.S. Pat. No. 8,328,377 (Issue Date Dec. 12, 2012). This is a new application and there is no claim of priority from any prior filed application.

BACKGROUND OF THE INVENTION

A. Field of the Invention

This relates to portable sources of light, particularly light that needs to be spread over a wide range, but only on a temporary basis. The device can be used in a variety of environments and is expected to be subjected to extremes in environmental conditions.

B. Prior Art

The applicant in this application is the owner of the original patent, Kothari, U.S. Pat. No. 8,939,593, that teaches many features that are contained in the current application. In the prior patent a metal halide light was used for illumination and in this application a LED array is used. The prior patent that is owned by the applicant does not teach a specific type of light, but this application teaches a specific means of illumination light that improves the prior issued patent.

BRIEF SUMMARY OF THE INVENTION

This is an improvement of an existing patent that was previously issued to the applicant in this case. In the prior patent a metal halide light was used as the source of illumination. In the current application, a LED array is used. The LED array is mounted in the same spot as the original halide light, but the use of an LED array has several distinct advantages.

The first advantage is the ability to quickly turn the LED array on and off without the cool down period that is required with a metal halide light, which uses a ballast to regulate the current. However, metal halide lights require a cool down period before being turned on again; the "cool down" period is not required with an LED array. A second advantage of using an LED array is the ability to easily regulate the current without sacrificing needed illumination. The ability to regulate the current will save power in the operation of the unit and extend the operation time of the light.

The current application also has a means to dissipate some of the heat that will be generated by this type of lighting system. A plurality of ventilation holes are placed in the mounting plate for the light. The blower fan that causes the tube to inflate will also force air through the ventilation holes. A plurality of heat sinks that are installed on the interior of the LED array will also help to dissipate the heat as the air flows past the heat sink.

This device is used for temporary lighting needs. This may be done in open fields at night, on ships at sea, or at events such as outdoor weddings and banquets. The light will be placed inside a long cylindrical tube that is inflatable.

When the device is not used the tube is deflated and the tube is rolled up and stored on the unit.

The structure will be comprised of a base structure that has a top surface and a series of other supporting members. Under the top surface an area will be provided to house a power source that will be used to inflate the tube and activate the light within the tube during normal operation. The device can be powered by both an electrical cord or a generator that has been incorporated into the unit.

On the top surface of the base structure will be mounted a cylindrical tube that houses the light and can be inflated to produce a light source. When the device is not used the tube with the light source can be easily folded and stowed. The device is designed to be portable.

A stabilizing pole that is secured to the top surface of the base structure will attach to a portion of the inflatable light structure or tube. More than one stabilizing pole may be used with this device to provide the needed stability. In the event of a sudden loss of power the stabilizing pole will prevent the light from falling quickly to the ground and potentially causing injuries to persons on the ground or damage to the equipment i.e. shattering of the light source.

The device itself is designed to be used primarily outdoors where lighting conditions are sometimes problematic. In an effort to stabilize the frame of the machine, a plurality of outrigger arms are also attached to the frame of the device. The stabilizing arms can easily be removed if not needed. The arms can also be rotated so that the user can find the ideal position for each of the arms.

Additionally, it may be necessary to either lengthen or shorten the length of the cylindrical light structure. This may become necessary due to the outside conditions that make it difficult to stabilize the light structure or because of height concerns in an area. A series of zippers around the perimeter of the light structure will provide a means to shorten or lengthen the light structure.

Near the bottom of the inflatable light structure will be a way to deflate the device, specifically an air vent. The air vent may be comprised of a variety of means to deflate the structure but a zipper is likely to be used.

A set of blowers, which are operated by a corresponding set of motors, on this device will supply a steady stream of air to inflate the tube that supports the light. Unfortunately, one of the effects of constant blower operation is the production of noise. A noise dampening device will be installed on the bottom of the blower motors. The housing will fit over the blower motor and will be insulated to provide noise reduction. A hole will be placed on the sides of the housing that will permit the air to flow freely through the chamber so that the flow of air is not interrupted and remains unimpeded.

The housing can be easily detached if replacement of the blower motor is needed.

NUMBERING REFERENCE

Figure 1:
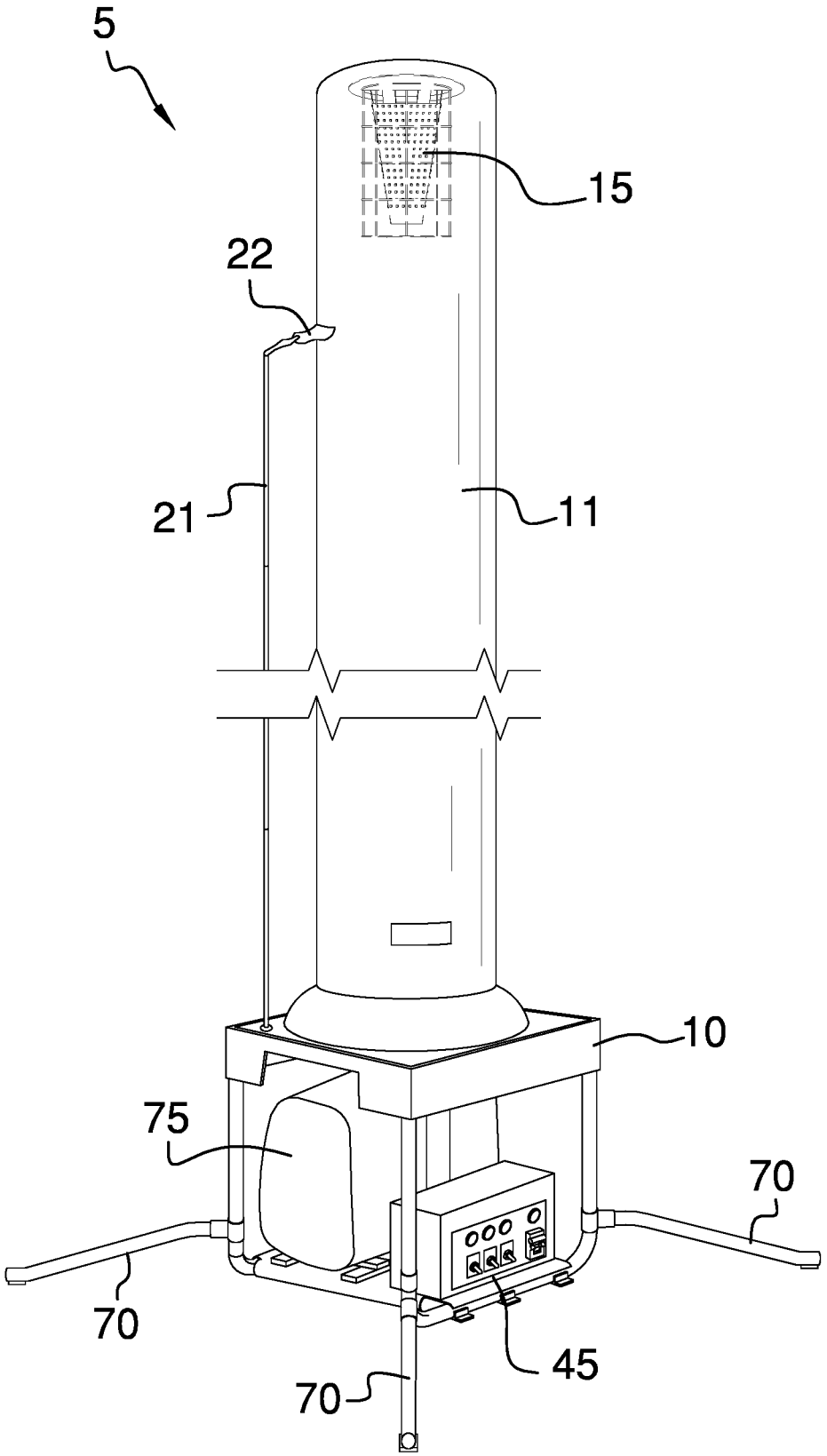
FIG. 1 is an isometric view of the device in the inflated stage with a depiction of the LED light at the top of the inflatable tube.

5 Device
10 Base
11 Inflatable Tube
15 LED Light
20 Plate
21 Stabilizing poles
22 Pole Attachment Strap
25 LED Array
30 Individual LED lights
35 Ventilation Holes
40 LED array single plate
45 Control Box
50 Heat Sink
55 Blower
60 Motor
65 LED drivers
66 Power Switch
67 Illumination Switch
68 Lamp Illumination
69 Blower Switch

DETAILED DESCRIPTION OF THE EMBODIMENTS

This device is intended to be a portable light source. This device may be used in extreme conditions either on land or at sea. It is designed to provide sufficient lighting during times of extreme conditions. The device is designed to be portable.

The device 5 will be comprised of a base member 10 on top of which is mounted an inflatable light structure 11, which will be translucent to provide the necessary amount of lighting for any given condition. The light structure 11 will be a predetermined height or length and likely cylindrical; it is anticipated that different lengths may be used.

The light structure 11 is likely to be of a synthetic material, although a variety of other materials may be used. One of the challenges with this type of device is controlling and venting the immense amount of heat that is generated. This is done using several different features that are unique to this light fixture but work in conjunction with each other to achieve the purpose of heat control. The features include the following: ventilation holes, heat sinks, a set of blowers and the ability to regulate the current.

It is important to regulate the amount of heat to enable the device to be used for longer periods of time and also extend the life of the equipment.

Figure 2:
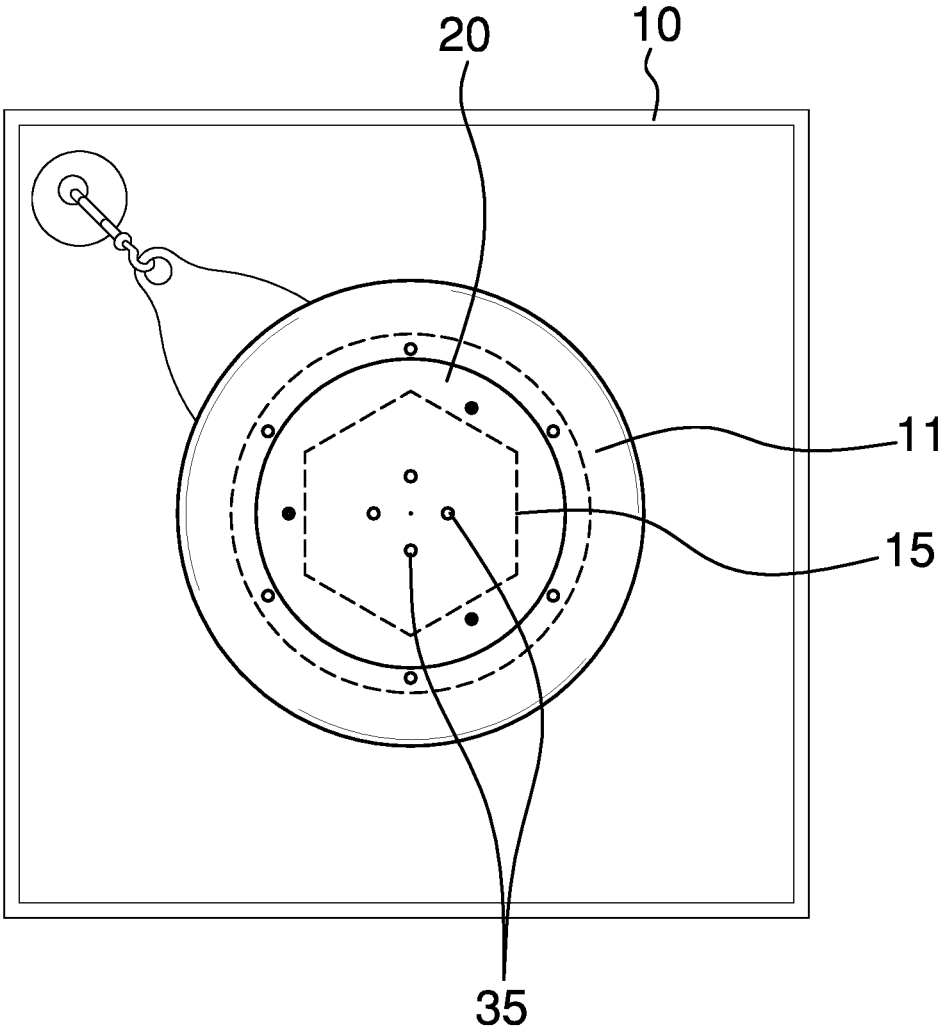
FIG. 2 is a top view of the tube showing the LED light and the ventilation holes.
Figure 4:
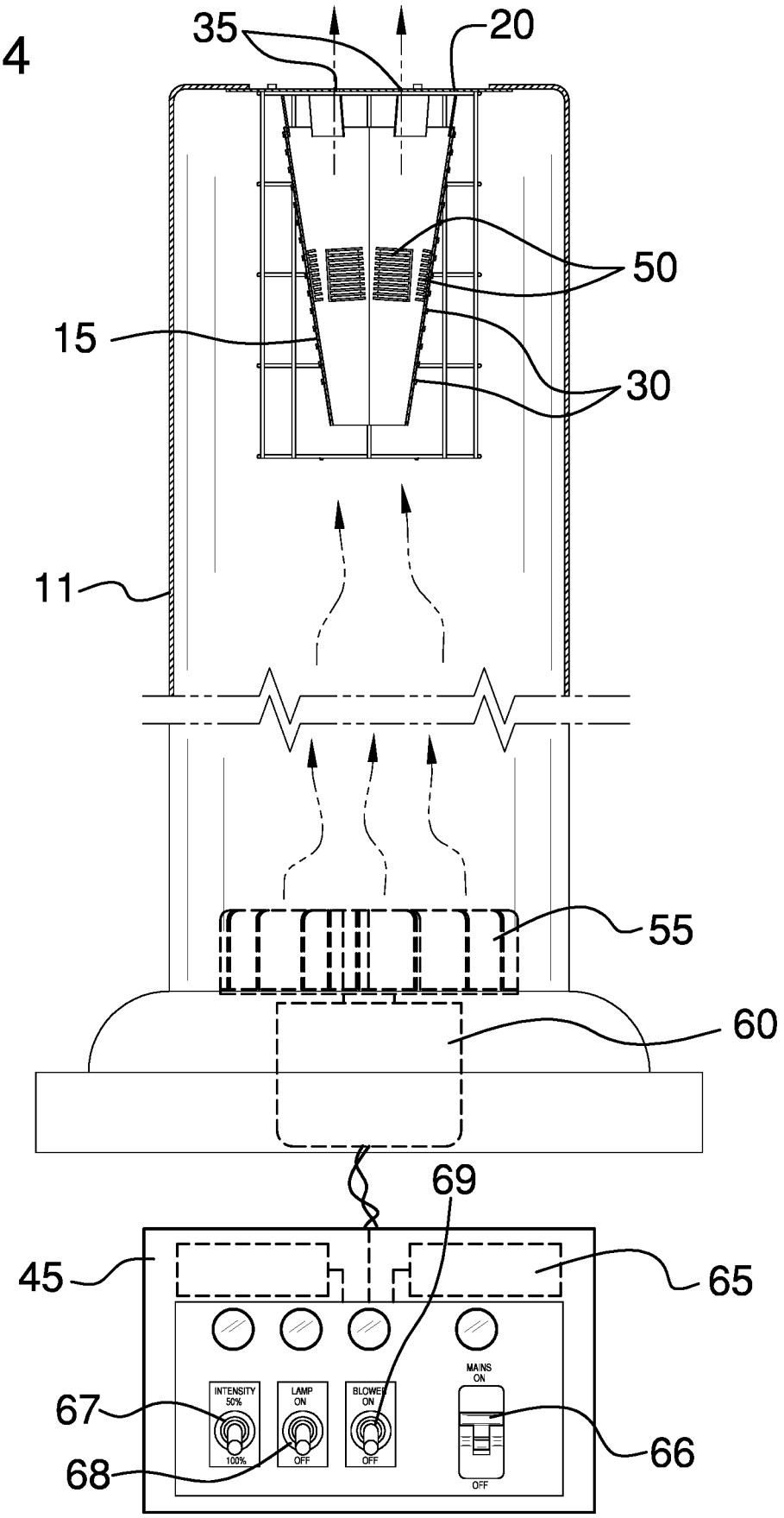
FIG. 4 is a fragmented front view of the device depicting the LED light array at the top of the structure and the control box at the bottom of the device.

The light structure 11 will house a LED array on the top of the tube such as depicted in FIG. 4 and will be secured to the interior of the tube using a plate 20. Ventilation holes 35 are placed on the plate 20 to allow some of the heat to be dissipated during normal operation of the device. FIG. 2 depicts a top view of the plate 20 with the ventilation holes 35.

Figure 3:
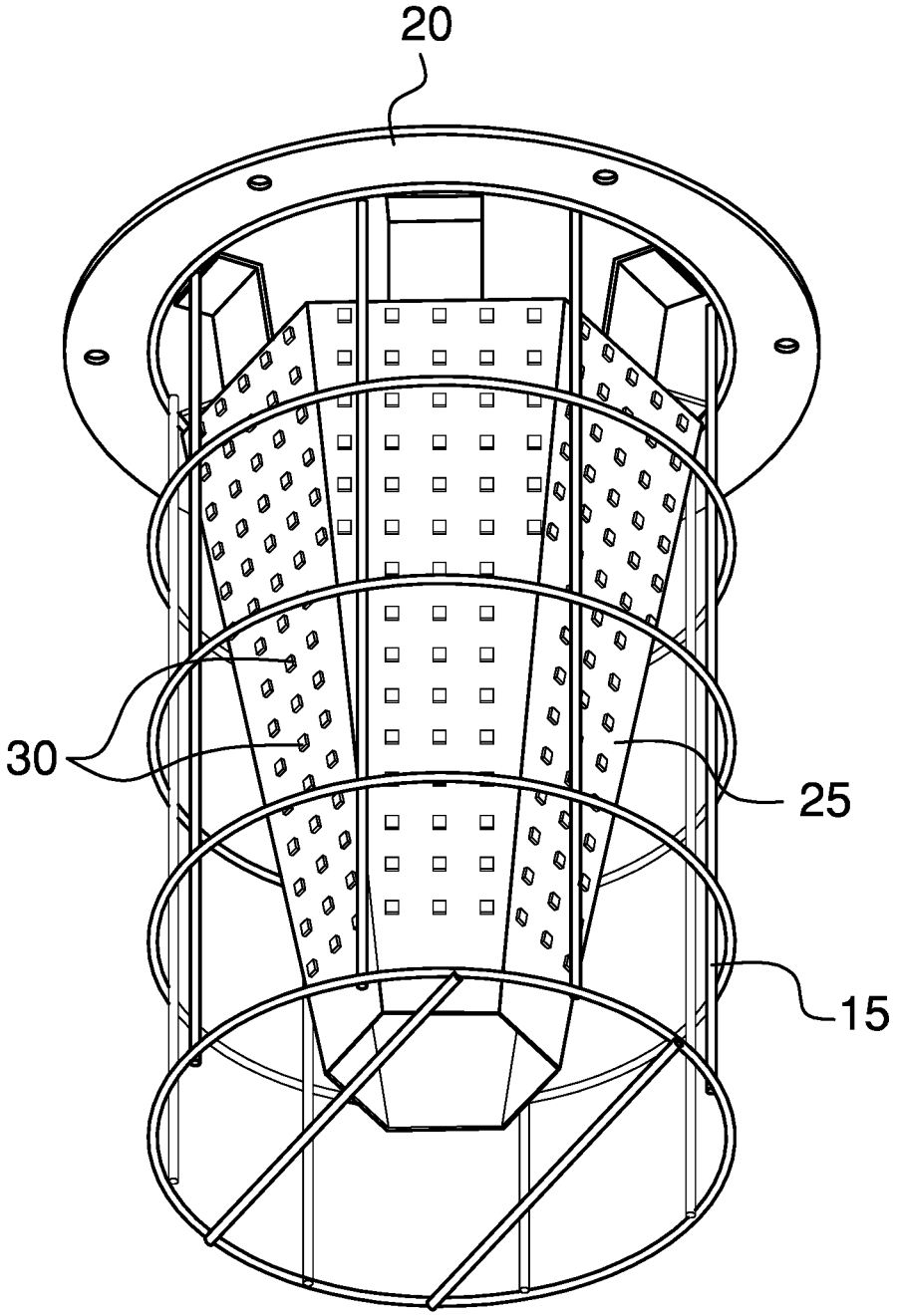
FIG. 3 is a bottom isometric view of the LED light array.
Figure 5:
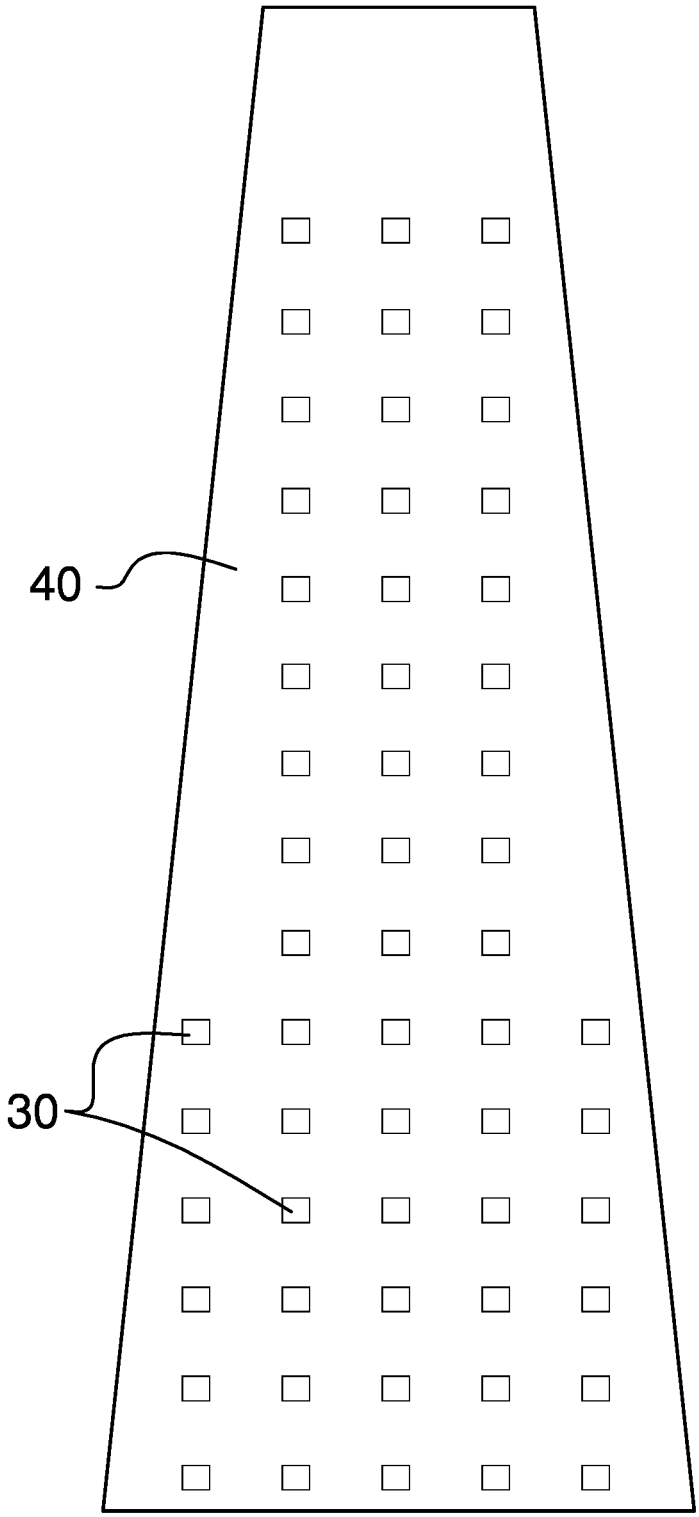
FIG. 5 is a front view of a panel of the LED array showing the individual LED lights in the array.
Figure 6:
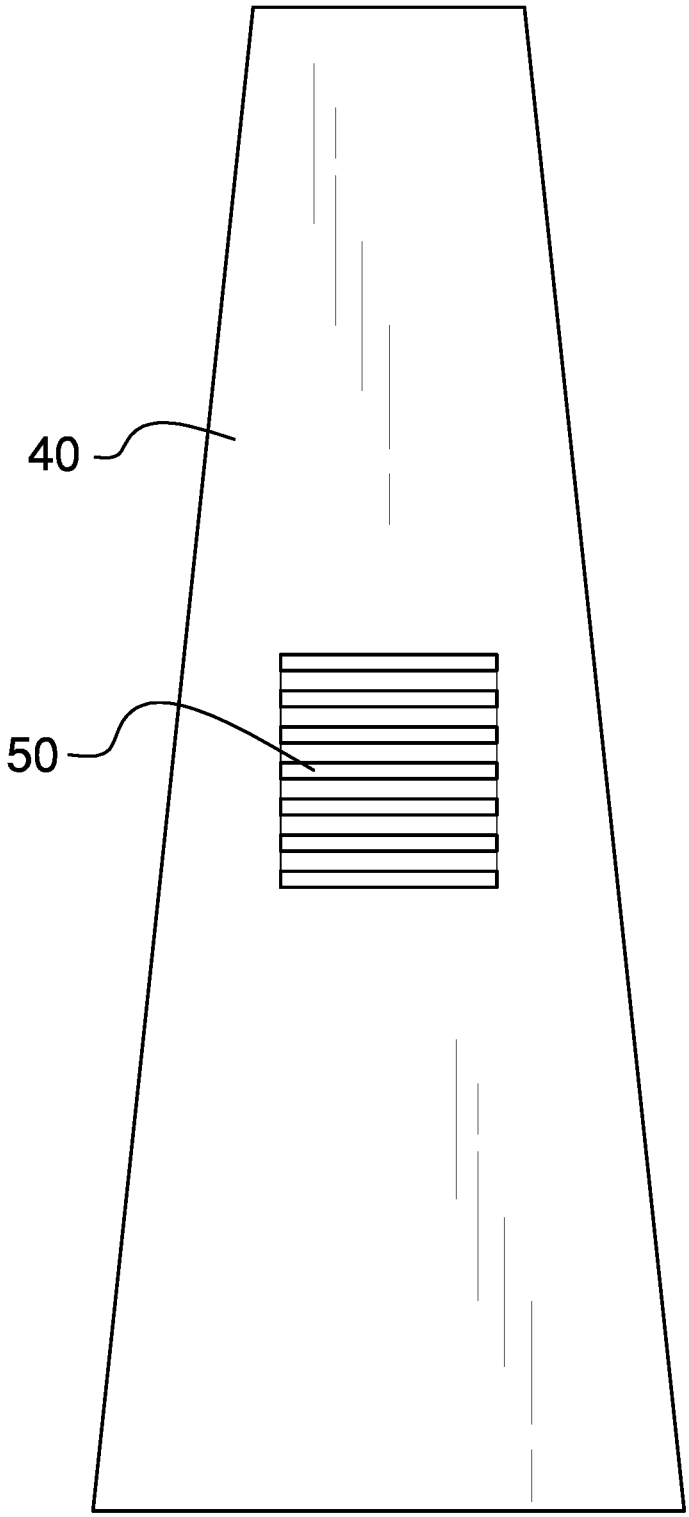
FIG. 6 is a back view of the panel of the LED array showing the heat sink.

The LED array 25 is comprised of a series of individual panels with the front of the panel depicted in FIG. 5 and the back view of the individual panel depicted in FIG. 6. The individual panels are arranged in a hexagon shape such as depicted in FIG. 3. A cage that appears in FIG. 3 is not claimed as part of this invention but is used to protect the LED light 15.

A plurality of heat sinks 50 are placed on the interior of each of the panels of the LED array to dissipate heat as well. A heat sink 50 is placed on each of the individual LED panels. The choice of material for the heat sink is balanced between the need to maintain inflation of the tube while providing some means to dissipate heat.

The set of blowers 55 that are used to inflate the tube will force air past the heat sinks 50 and through the ventilation holes 35 to control the heat buildup in the unit. The set of constant speed motors 60 control the operation of the set of blowers. A power source, either an electrical cord or a generator, will provide power for the components of the device.

A metal halide light uses ballast to regulate current within the light. The metal halide light is either completely off or completely on. If a metal halide light is turned off, there must be a cooling down period, which is referred as the "strike time" of the light in the industry, before it can be turned back on safely. This delay may become problematic in the field using a metal halide light.

Conversely, a LED light driver converts the alternating current from either the electrical cord or the generator to a direct current; the conversion is accomplished by a LED driver that will drive power to the individual LEDs in the array. One of the advantages of the LED array is energy efficiency because the individual LEDs do not require much power (usually between 2V and 4V) to be operational. However, a LED, to function at its maximum potential, must operate at a constant, exact voltage; this is accomplished by the LED driver. There are different types of LEDs on the market but the LED driver that is used in this application is a mix mode LED driver with a power factor correction. This type of LED driver will provide both constant voltage and constant current to protect the light and maximize the life of the light.

With this application the user can moderate the LED array by supplying power to all the individual LEDs 30 on the array (light at 100% power) or turning off one-half the individual LEDs on the array (light at 50% power). If only one-half the individual LEDs are used it will result in less power consumption and less heat generation. The ease of power regulation with an LED array does not sacrifice illumination; the device will provide illumination at either "full power" or "half power" and this can be achieved by simply throwing a switch and does not require the cool down period of the metal halide light.

A control box 45 that includes the LED drivers 65 permits the ease of power regulation within the LED array. When the entire LED array is to be illuminated a switch for full power on the illumination switch 67 is set to the 100% setting; when only one-half the LED array is to be used a switch for the illumination switch 67 is engaged to the 50% setting. A power switch 66 will allow the LED array and all other components to become operational. A separate switch for the lamp 68 is included. A blower switch 69 is also included to enable the user to operate the set of blowers 55 independently of the other components, if desired; the blower switch 69 controls the operation of the set of constant speed motors that operate the set of blowers 55.

With the traditional metal halide light the previously mentioned methods of current regulation and heat dissipation were not available. While the blower was used to inflate the tube, there were no ventilation holes and no heat sinks in the metal halide light. Additionally, there was no way to regulate the current in the metal halide light example.

Another disadvantage of the metal halide light was the long strike times that were involved between turning the light off and on. If the light is on and then turned off, the user must wait for the light to cool down before it is turned back on. In the example of an LED array the light can be turned on without needing a cool down period.

In order to stabilize the lighting structure, particularly during windy conditions, a pole attachment flap 22 will be positioned on the side of the light structure 11. This pole attachment strap 22 will be secured to a stabilizing poles 21, which can be inserted into a cavity on the top surface of the base 10 to secure the stabilizing poles to the pole attachment strap 22.

In the event of a sudden power failure the stabilizing poles 21 will prevent the tube 11 from suddenly deflating and injuring persons on the ground and preventing damage to the LED light.

The electrical circuitry that operates the blower and the light will be constructed so that these elements will operate separately from each other; the wiring is constructed so that the light will not operate until the blower is operational to prevent a build up of heat by the light. The circuitry is configured so that the lamp can be turned off independent of the blower. Prior to the device being deflated through the use of a plurality of air vents, the lamp can be turned off to allow the structure to cool down before it is deflated and stowed again on the base.

While the embodiments of the invention have been disclosed, certain modifications may be made by those skilled in the art to modify the invention without departing from the spirit of the invention.

The inventor claims:

1. A temporary portable lighting structure that is comprised of:

a. a light structure;
wherein the light structure is a predetermined length;
wherein the light structure has a predetermined shape;
wherein a light is secured to the interior of the lighting structure;
wherein the light structure can be inflated;
b. a means of illumination;
wherein the means of illumination is mounted to a plate near the top of the light structure;
wherein the means of illumination is a LED array;
wherein the LED array is comprised of a plurality of panels to form the LED array;
wherein individual LED lights are placed on the plurality of LED panels;
c. a plurality of heat sinks;
wherein the plurality of heat sinks are placed on the interior surface of each panel of the LED array;
d. a control box;
wherein the control box houses a plurality of switches and a plurality of LED drivers (power regulator);
e. a plurality of ventilation holes;
wherein the plurality of ventilation holes is placed on the plate;
f. a set of blowers;
wherein the set of blowers inflate the light structure;
wherein a set of constant speed motors operate the set of blowers;
g. a base;
wherein said base supports the light structure;
wherein the base has a top surface of predetermined dimensions;
h. a plurality of stabilizing pole;
wherein the stabilizing poles are used;
wherein the stabilizing poles are placed in a cavity on the top surface of the base;
i. a pole attachment flap;
wherein the pole attachment flap is placed on the lighting structure;
wherein the stabilizing pole is secured to the rod attachment flap;
l. a means to deflate the light structure;
wherein the means to deflate the light structure is placed on the light structure;
m. a power source;
wherein a power source is provided;
said power source operates the means to inflate the light structure;
said power source operates the light;
wherein the means to inflate and the means to illuminate operate independently of each other.

2. The device as described in claim 1 wherein the current is regulated by the LED driver.

3. The LED driver as described in claim 2 wherein the means of illumination can be operated at full power.

4. The LED driver as described in claim 2 wherein the means of illumination can be operated at half power.

* * * * *